US006543701B1

(12) United States Patent
Ho

(10) Patent No.: US 6,543,701 B1
(45) Date of Patent: Apr. 8, 2003

(54) POCKET-TYPE ULTRASONIC ATOMIZER STRUCTURE

(76) Inventor: Tung-Huang Ho, P.O. Box 63-150, Tai Chung City (TW), 406

( * ) Notice: Subject to any disclaimer, the term of this patent is extended or adjusted under 35 U.S.C. 154(b) by 0 days.

(21) Appl. No.: 10/028,177

(22) Filed: Dec. 21, 2001

(51) Int. Cl.[7] ..... B05B 1/08

(52) U.S. Cl. ..... 239/102.1; 239/338; 239/102.2; 310/317; 128/200.16

(58) Field of Search ..... 239/102.1, 102.2, 239/338; 310/321, 322, 323, 324, 325, 317; 128/200.14, 200.16

(56) References Cited

U.S. PATENT DOCUMENTS 4,334,531 A * 6/1982 Reichi et al. ..... 128/200.14
4,877,989 A * 10/1989 Drews et al. ..... 239/102.2
5,803,362 A * 9/1998 Fraccaroli ..... 239/102.2
5,950,619 A * 9/1999 van der Linden et al. ..... 128/200.16
6,273,342 B1 * 8/2001 Terada et al. ..... 239/102.2

* cited by examiner

*Primary Examiner*—Michael Mar
*Assistant Examiner*—Dinh Q. Nguyen

(57) ABSTRACT

A pocket-type ultrasonic atomizer structure comprised of a water reservoir, an atomization chamber and an atomizing unit of a main unit, and a water supply regulating mechanism, wherein the opening and closing of the water supply regulating mechanism and the water reservoir is integrated such that closing the water reservoir enables the simultaneous entry of a volume of water required in the atomization chamber through atmospheric pressure and the maintenance of a preset liquid surface height to thereby achieve low-voltage atomizing performance.

3 Claims, 10 Drawing Sheets

POCKET-TYPE ULTRASONIC ATOMIZER STRUCTURE

BACKGROUND OF THE INVENTION

1) Field of the Invention

The invention herein relates to atomization devices, specifically a pocket-type ultrasonic atomizer structure.

2) Description of the Prior Art

Conventional atomizers typically utilize an ultrasonic vibrating component disposed at the lower extent of an atomization chamber, an electronic circuit that oscillates at an ultrasonic frequency to drive the vibrating component, and the positive and negative leads of a water level sensor positioned along the water line in a water reservoir that measures and maintains a safe volume of water. During operation, a sonic field is generated by the ultrasonic vibrating component that atomizes liquid in the water reservoir. Since the water reservoir of a conventional atomizer is of an open design, the liquid surface area must be maintained at a higher water volume and level, with the ultrasonic vibrating component unavoidably requiring a larger sonic wave exciter surface area to generate a sonic field that is sufficient to atomize the liquid in the water reservoir. As such, the design of conventional atomizers is limited to high-voltage, indoor operated medical and cosmetic application units that cannot be utilized in vehicles or other low-voltage environments. At the same time, since conventional atomizers are of larger physical dimensions, they are impractical for portable usage. Furthermore, since the water reservoirs of such atomizers are kept sealed by a single washer, their water tightness is poor and seepage frequently occurs as the washer deteriorates, which affects the performance of the atomizer (the ultrasonic vibrating component). Due to the design problems, atomizer development has been greatly hampered and wider utilization in daily life has not been possible.

In view of the situation, the inventor of the invention herein conducted continuous research and testing based on many years of experience gained in the manufacturing and marketing of this category of products which culminated in the successful development of the practical invention herein.

SUMMARY OF THE INVENTION

The primary objective of the invention herein is to provide a pocket-type ultrasonic atomizer structure in which opening the water reservoir enables the simultaneous entry of a volume of water required in the atomization chamber through atmospheric pressure and when the water reservoir is closed, a preset liquid surface height is maintained in the atomization chamber to achieve atomization at lower water levels.

Another objective of the invention herein is to provide a pocket-type ultrasonic atomizer structure in which the atomizing unit is totally leakproof to increase atomizing performance.

Therefore, the pocket-type ultrasonic atomizer structure of the invention herein is comprised of a main unit, a water supply regulating mechanism, and an atomizing unit, of which:

The main unit consists of a bottom cover, a middle casing, and an upper casing assembled into a vertical construct; the bottom cover is secured onto the underside of the middle casing; the middle casing consists of a compartment into which is installed a fan and other structural components, and a hollow ventilator duct and a hollow pipe extending vertically from its top side, with a water input hole formed in the pipe near its bottom end and a connective channel disposed between the pipe and ventilator duct; the upper casing is hermetically conjoined to the top section of the middle casing, the sealed interior section thereby formed between them providing for a water reservoir and, furthermore, a filler opening for adding water, a pivot hole, and an output port for diffusing atomized particles are respectively disposed on its top side, with a mist tube movably sleeved onto the mouth of the output port.

The water supply regulating mechanism consists of a valve controlling stem, which is an active tubular component installed inside the middle casing hollow pipe, having a valve on its bottom end that is aligned with the inner diameter of the pipe and an adjustment knob at its top end, the adjustment knob is utilized to rotate the valve controlling stem within a range of preset angles, thereby synchronously controlling the attached valve to open or close the water input hole at the inner wall of the pipe; and a pressure cover that is friction fitted into the upper casing filler opening and, furthermore, secured in place by a check section projecting from the adjustment knob that exerts downward pressure against its top side.

The atomizing unit consists of an accumulator, an elastic sleeve, a vibrator element, a conductive ring, and a circuit board, wherein the accumulator is disposed at the lower extent of the upper casing ventilator duct within the interior section of an atomization chamber therein formed which has a conical space at its bottom end, an orifice through the center of the conical space, an annular groove section of a tapered contour formed around the orifice, and a coupling ring placed around the annular groove section, and a circular wall extending outward axially and concentrically from the outer circumference of the coupling ring; the elastic sleeve is a soft insulation fitting having an inner conical section that provides for aligned insertion into the conical space of the accumulator, an annular shoulder section of a stepped profile contoured downward along the inner diameter of the conical section that produces a constricted passage of a very small diameter at the bottom side of the orifice, a round hole that is aligned with the accumulator orifice, an annular edge extending downward from the outer diameter of the elastic sleeve, and an enclosing space receding towards its interior section; the vibrator element is inserted flat into the elastic sleeve enclosing space and is capable of generating a sonic field sufficient to efficiently atomize liquid from the water reservoir; the conductive ring is a thin annular component dimensioned to fit into the enclosing space having an end surface firmly attached to the bottom side of the vibrator element; and the circuit board is an electronic control circuit that is tightly fastened to the accumulator within the interior section of the middle casing compartment.

Given the assembly, the opening and closing operation of the water supply regulating mechanism and the water reservoir is integrated such that closing the water reservoir enables the simultaneous entry of a volume of water required in the atomization chamber for atomization and maintains a preset liquid surface height in the atomization chamber; at the same time, the compounded axial arrangement of the elastic sleeve at the bottom side of the accumulator enables the appropriate lengthening of the distance between the end opening of the accumulator orifice and the end surface of the aligned vibrator element and, as such, the present invention achieves low-voltage, low water level atomizer operation and provides an atomizing unit having exceptional leak-proof, atomization performance.

To enable the examination committee a further understanding of the objectives, function, and advantages of the invention herein, the brief description of the drawings below are followed by the detailed description of the most preferred embodiment of the invention herein.

DETAILED DESCRIPTION OF THE INVENTION

Figure 1:
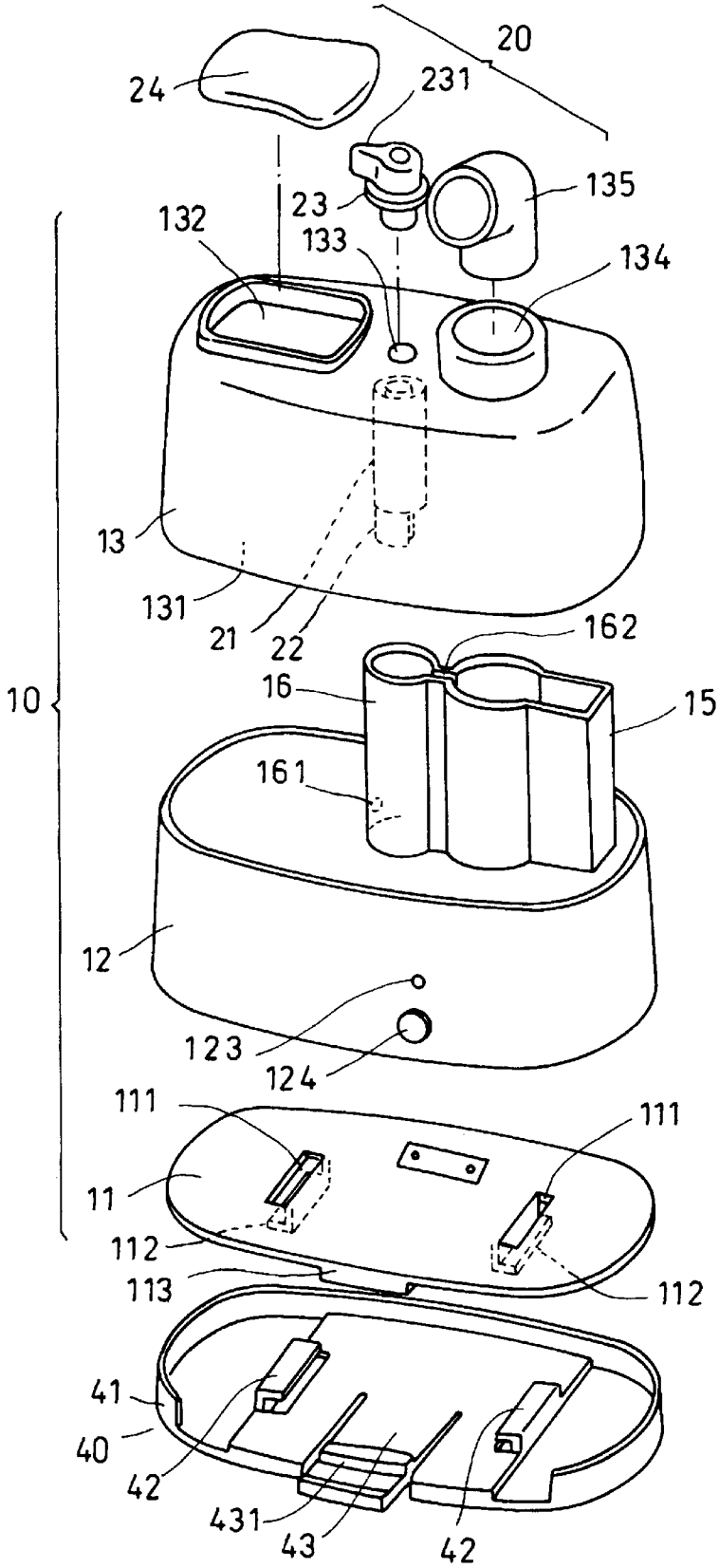
FIG. 1 is an exploded drawing of the most preferred embodiment of the invention herein.

Referring to FIG. 1, FIG. 2, FIG. 3, FIG. 4, and FIG. 5, the pocket-type ultrasonic atomizer structure of the invention herein is comprised of a main unit 10, a water supply regulating mechanism 20, and an atomizing unit 30, of which:

The main unit 10 consists of a bottom cover 11, a middle casing 12, and an upper casing 13 assembled into a vertical body; the bottom cover 11 is secured into position on the underside of the middle casing 12 and has two elongated openings 111 recessed in the extremities of its surface, with an L-shaped projection 112 extending in parallel from the bottom side of each elongated opening 111; the middle casing 12 consists of a compartment 121 into which is installed a fan 14, a circuit board 35, and the atomizer unit 30; a power supply socket hole 122, an indicator light 123, and a push button switch 124 situated on its exterior sides; a hollow ventilator duct 15 and a hollow pipe 16 extending vertically from its top side, with a water input hole 161 formed in the pipe 16 near its bottom end and a connective channel 162 disposed between the pipe 16 and ventilator duct 15. The upper casing 13 is hermetically conjoined to the top section of the middle casing 12, the sealed interior section thereby formed between them providing for a water reservoir 131 (as shown in FIG. 4) and, furthermore, a filler opening 132 for adding water, a pivot hole 133, and an output port 134 for diffusing atomized particles are respectively disposed on its top side, with a mist tube 135 movably sleeved onto the mouth of the output port 134.

Figure 4:
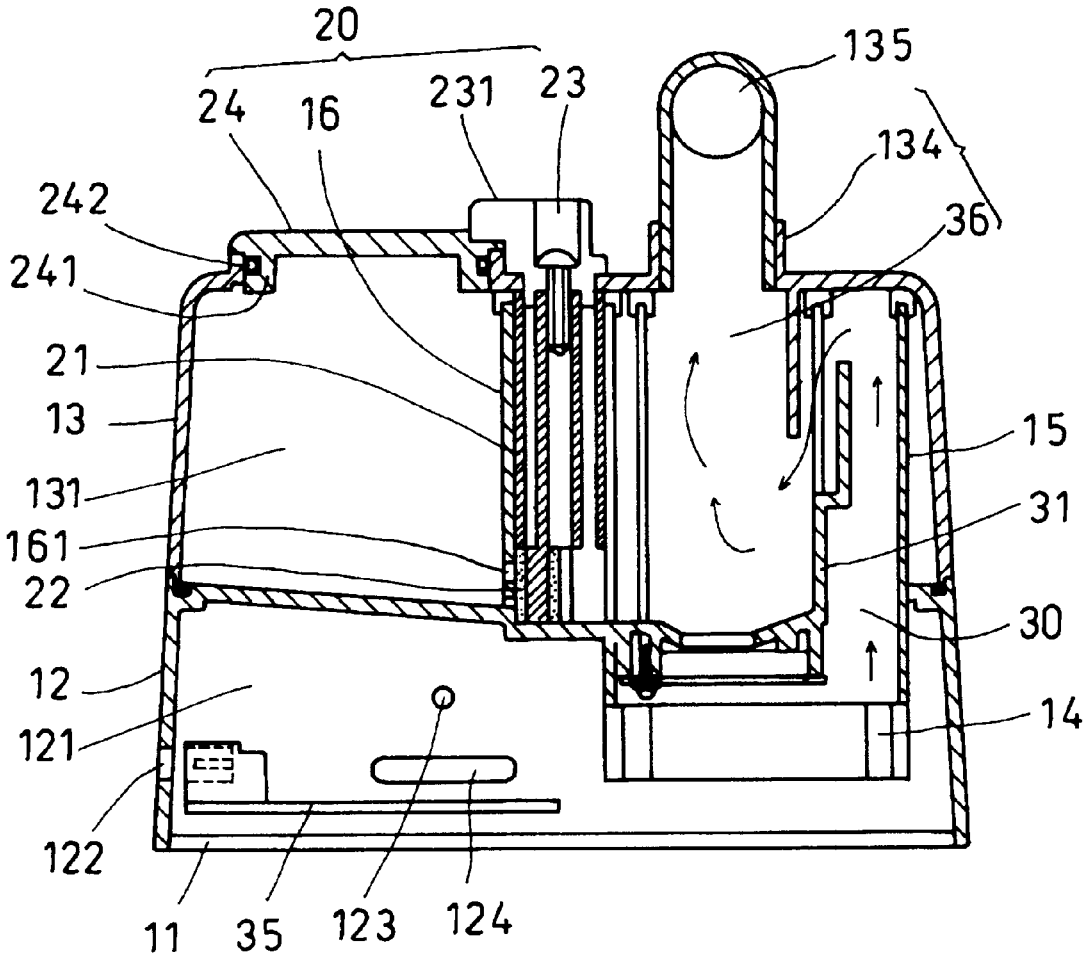
FIG. 4 is a cross-sectional drawing of the most preferred embodiment of the invention herein.
Figure 6:
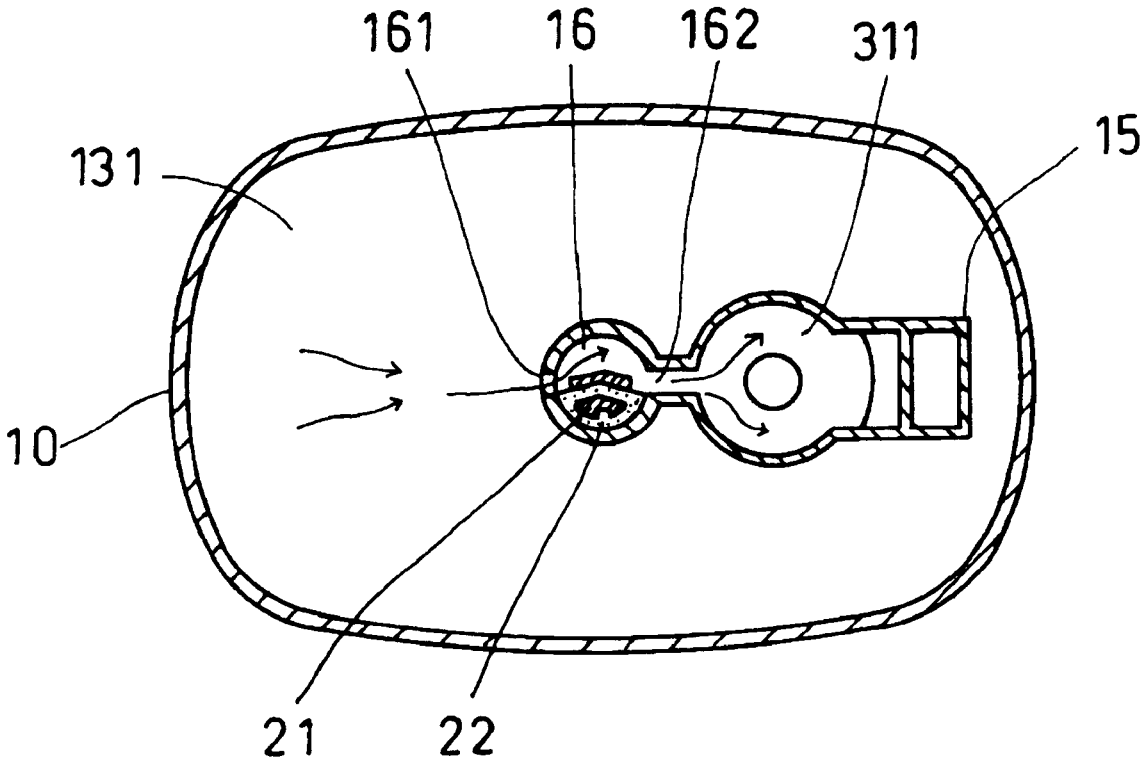
FIG. 6 is a cross-sectional drawing of the invention herein illustrating the automatic water supply operation.
Figure 7:
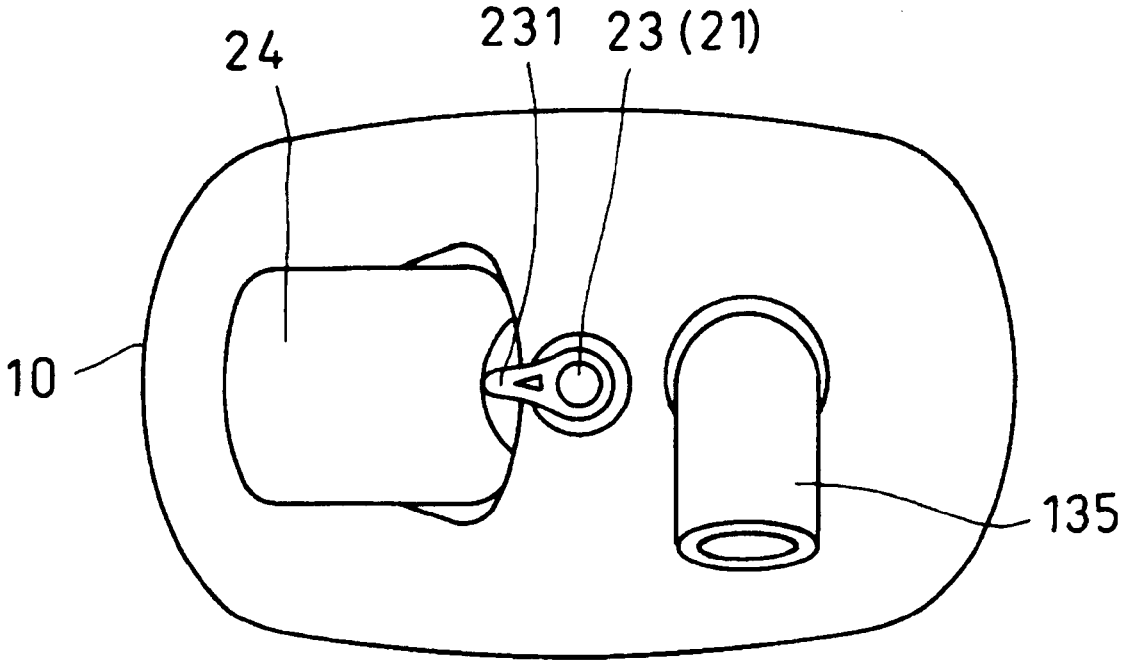
FIG. 7 is an orthographic drawing of the invention herein during automatic water supply.

The water supply regulating mechanism 20 consists of a valve controlling stem 21, which is an active tubular component installed inside the middle casing 12 hollow pipe 16 (as shown in FIG. 4), having a valve 22 on its bottom end that is aligned with the inner diameter of the pipe 16 and an adjustment knob 23 at its top end, with the adjustment knob 23 utilized to rotate the valve controlling stem 21 within a range of preset angles, thereby synchronously controlling the attached valve 22 to open, vary, or close liquid flow through the water input hole 161 at the inner wall of the pipe 16 (as shown in FIG. 6); to ensure that the water reservoir 131 supplies water at a normal pressure and equilibrium, a pressure cover 24 is required that corresponds to the shape of the filler opening 132, the pressure cover 24 having a constraining edge 241 extending downward along the bottom side as well as a matching gasket 242 around the lateral periphery that enables friction fitting into the filler opening 132 and, furthermore, a check section 231 projecting from the adjustment knob 23 is capable of applying sufficient downward pressure against the pressure cover 241 to secure it and achieve an air-tight seal (as shown in FIG. 7); as such, water regulation and water reservoir 131 opening and closing are integrated such that releasing water reservoir 131 pressurization enables the simultaneous entry of a required volume of water; specifically, the water reservoir 131 opening operation also maintains the liquid surface height at the level previously admitted.

Figure 2:
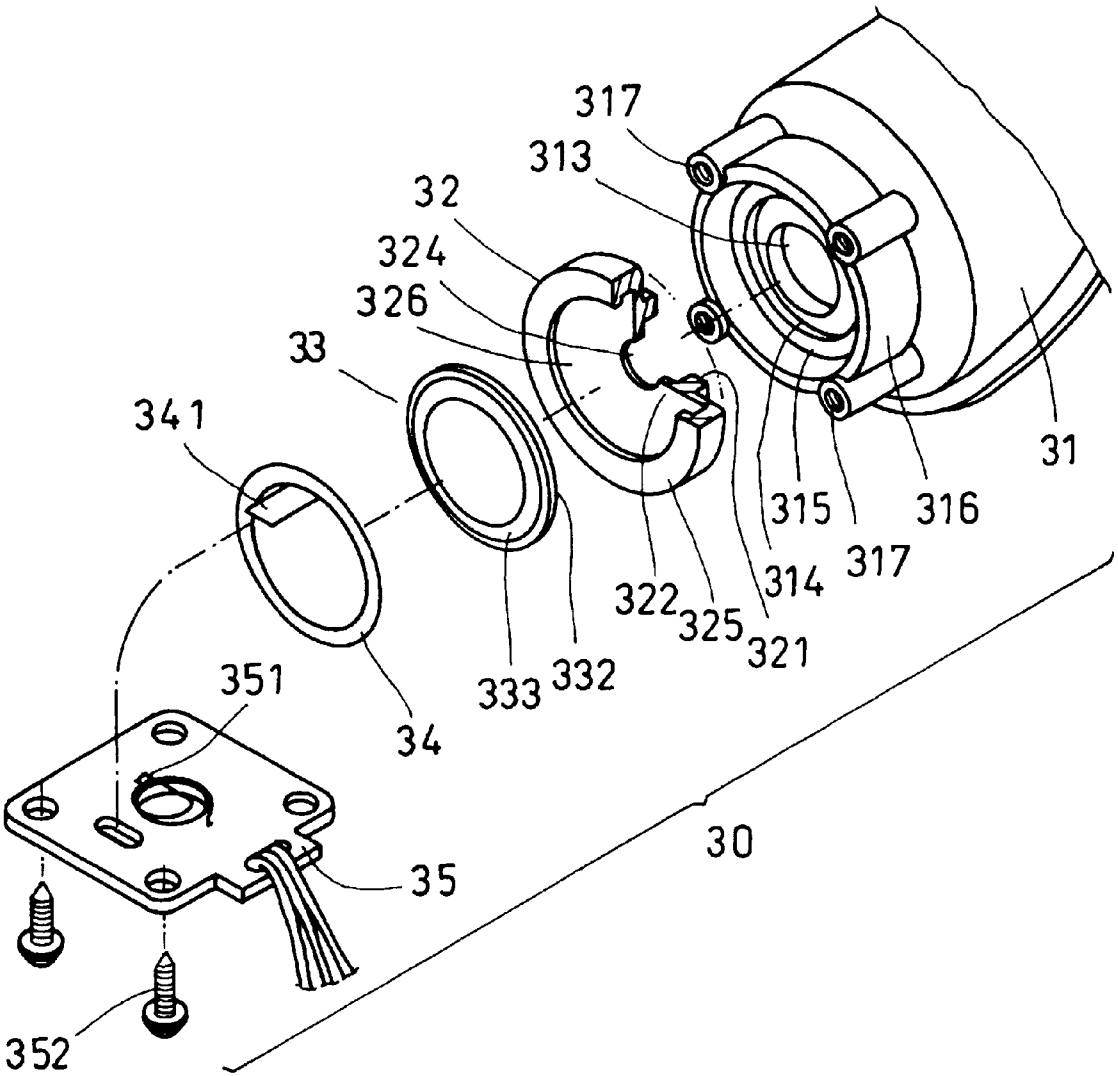
FIG. 2 is a magnified exploded drawing of the atomizing unit of the invention herein.
Figure 5:
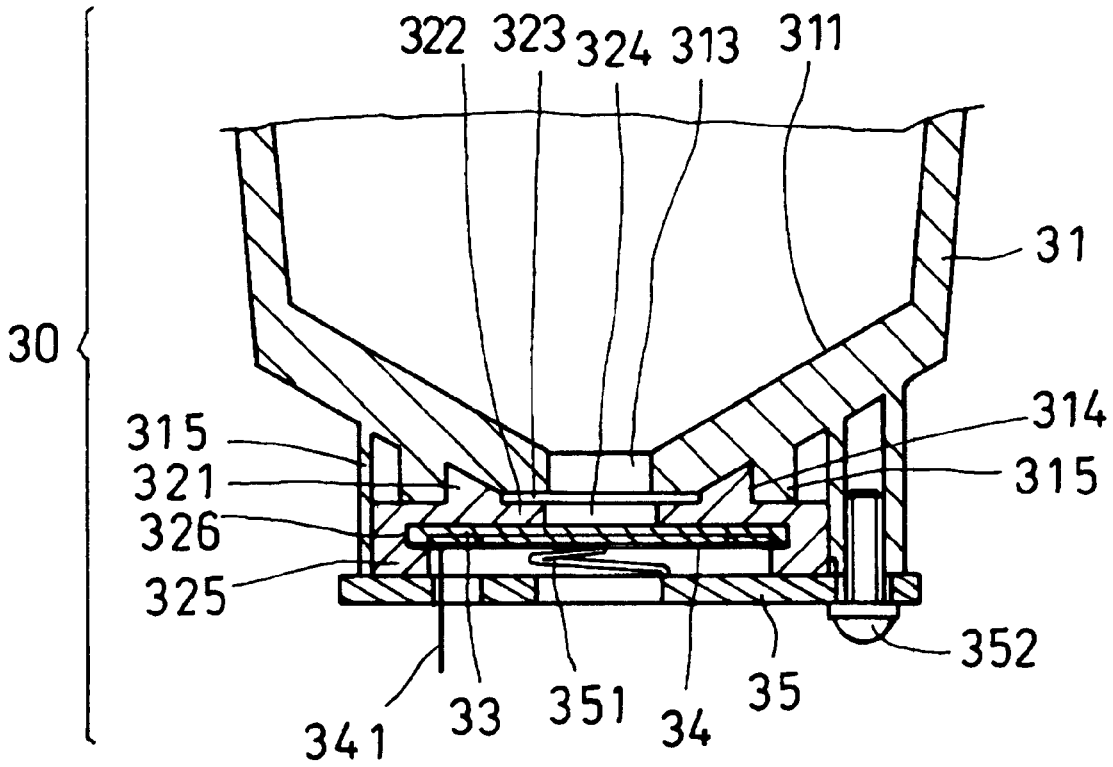
FIG. 5 is a partial cross-sectional drawing of FIG. 2.

The atomizing unit 30, as indicated in FIG. 2, consists of an accumulator 31, an elastic sleeve 32, a vibrator element 33, a conductive ring 34, and a circuit board 35, wherein the accumulator 31 is a cup-shaped construct disposed at the lower extent of the upper casing 13 ventilator duct 15 within the interior section of an atomization chamber 36 therein formed (as shown in FIG. 4) that has a conical space 311 (as shown in FIG. 5) at its bottom end, an orifice 313 through the center of the conical space 311, an annular groove section 314 of a tapered contour formed around the orifice 313, a coupling ring 315 placed around the annular groove section 314, and a circular wall 316 extending outward axially and concentrically from the outer circumference of the coupling ring 315, which also has four threaded hole mounts 317 that provide for the fastening of screws respectively disposed at intervals along an area beyond its outer diameter. The elastic sleeve 32 is a soft insulation fitting having an inner conical section 321 that provides for aligned insertion into the conical space 311 of the accumulator 31, an annular shoulder section 322 of a stepped profile contoured downward along the inner diameter of the conical section 321 that produces a constricted passage 323 of a very small diameter at the bottom side of the orifice 313, a round hole 324 that is aligned with the accumulator 31 orifice 313, an annular edge 31 extending downward from the outer diameter of the elastic sleeve 32, and an enclosing space 326 receding towards its interior section. The vibrator element 33 is a conventional structure consisting of an upper electrofilm layer 332 and a lower electrofilm layer 333 respectively disposed at the two ends of a ceramic body 331 that is inserted flat into the elastic sleeve 32 enclosing space 326. The conductive ring 34 is a thin annular component dimensioned to fit into the enclosing space 326 having an end surface firmly attached to the vibrator element 33 lower electrofilm layer 333 and a tab 341 projecting downward from one side that is inserted into the circuit board 35 for wiring purposes. The circuit board 35 is integrated circuit-based and provides for the automatic control features of the invention herein; it is equipped with a spring contact component 351 that enables electrical continuity when the circuit board 35 is fastened by screws 352 to the four threaded hole mounts 317 at the bottom side of the accumulator 31.

Figure 10:
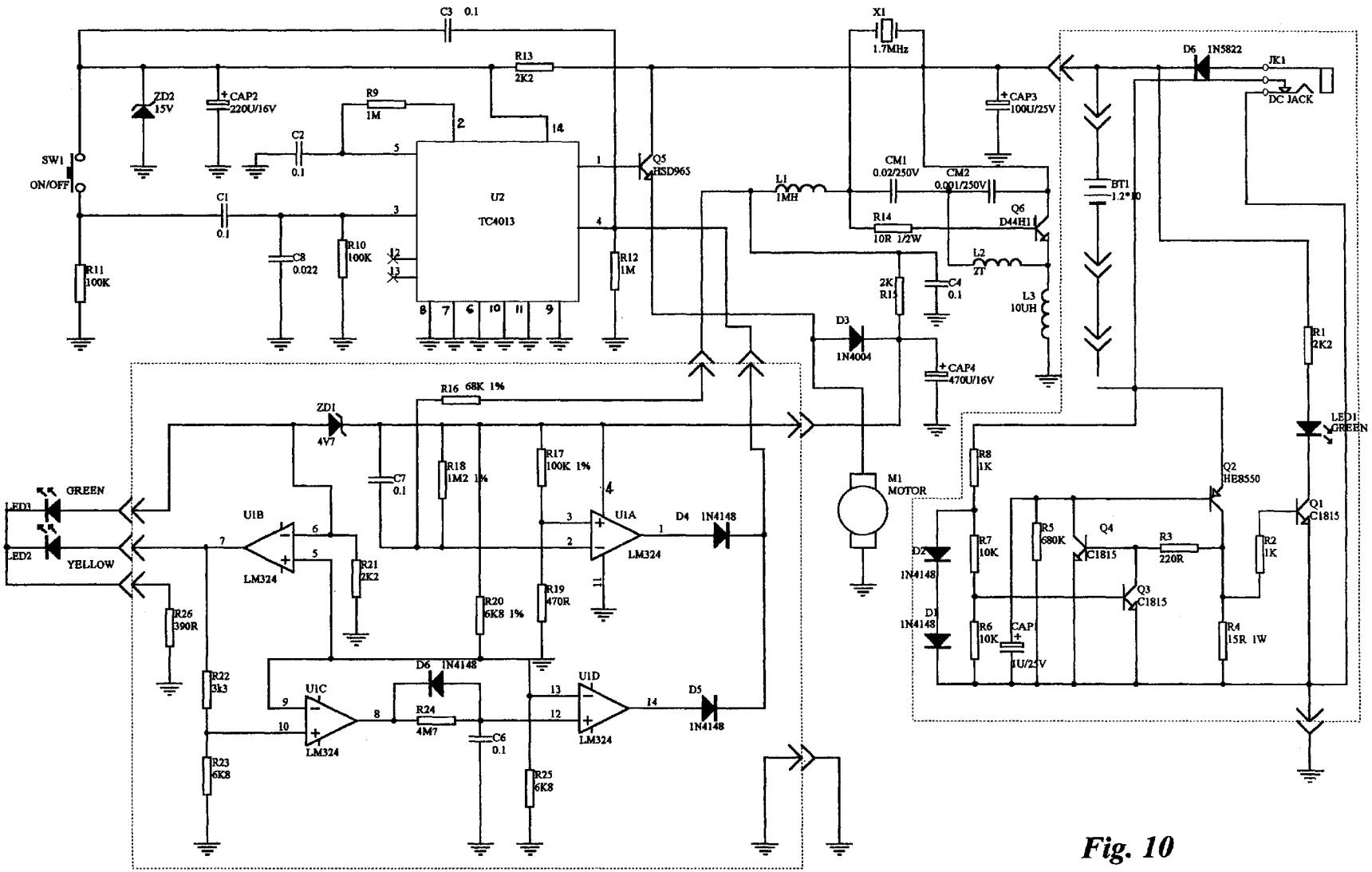
FIG. 10 is a schematic drawing of the automatic power shut-off circuit of the invention herein.

The control circuit of the invention herein, referring to FIG. 10, consists of three sections, the electronic principles of which are briefly described below:

1. Crystal Oscillator Operation

Pressing the switch SW1 to the ON position delivers electricity from the power supply to pin 14 of integrated circuit U2 and then to pin 3 of U2 following voltage stabilization by Zener diode ZD2, thereby starting the operation of U2 and enabling a high voltage level output from its pin 1 that is amplified and then supplied to the fan 14 and the base of transistor Q6, enabling the operation of Q6 and the oscillation of crystal X1.

2. Low Voltage and no Water Protection

When the power supply input is less than DC9.8V, a high voltage level is output from pin 7 of operational amplifier LM324 which results in high voltage level output from pin 4 of U2 and a low voltage level output from pin 1, thereby preventing atomization. When no water is present in the accumulator 31, a low voltage level occurs at pin 4 of U2 to terminate atomization.

3. Battery

When the battery is discharged, the base of transistor Q3 is at a low voltage level and its collector is at a high voltage level, thereby triggering transistor Q1 and causing the indication light LED1 to glow green; when the battery is charged, the base of transistor Q3 is at a high voltage level and its collector is at a low voltage level, thereby disabling Q1 and switching off LED 1.

Figure 3:
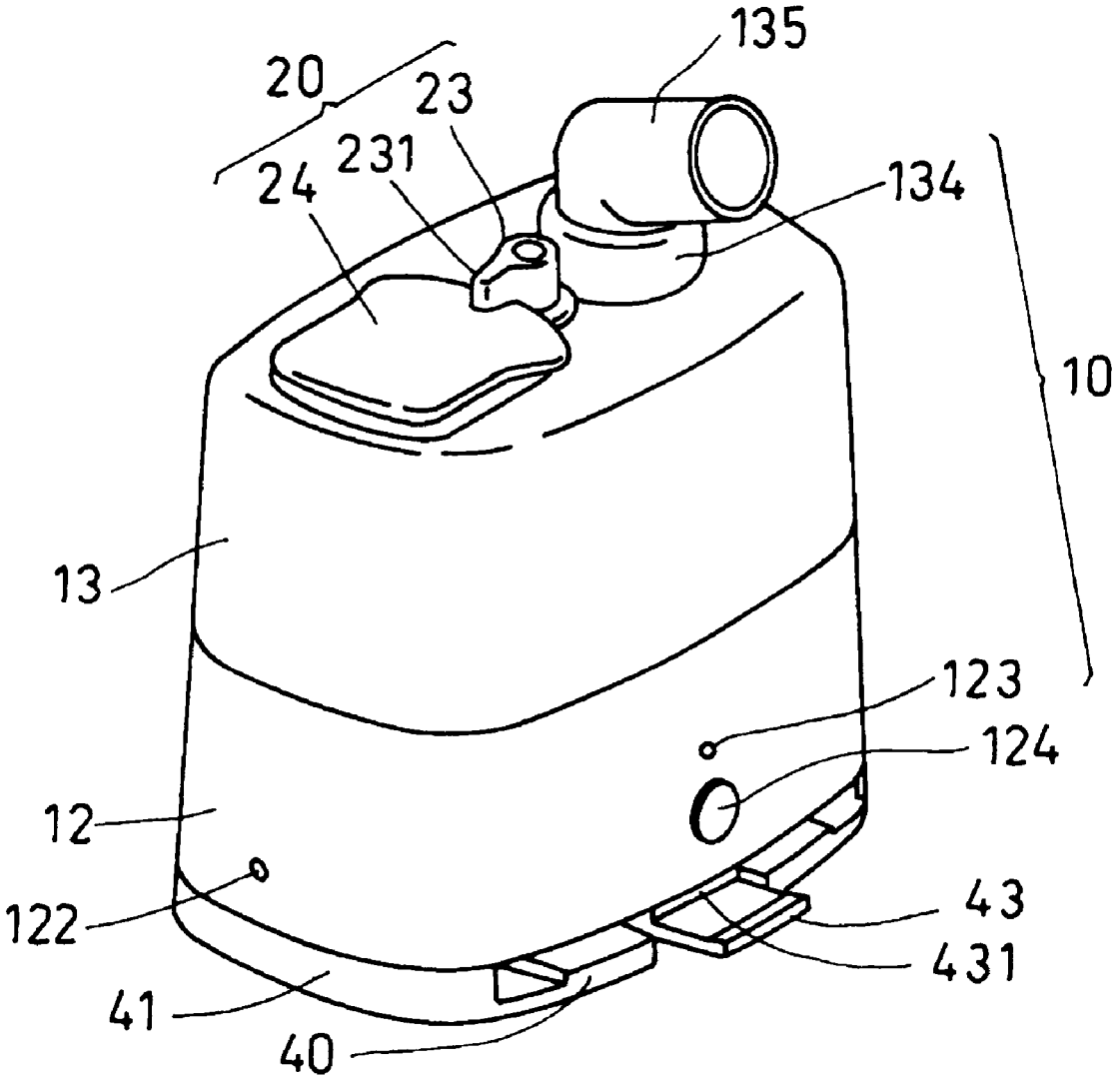
FIG. 3 is an isometric drawing of the most preferred embodiment of the invention herein.

In addition, the pocket-type ultrasonic atomizer structure of the invention herein is even more convenient to operate and utilize because a mounting base 40 or an accessory battery base 50 can be optionally assembled to the bottom section of the main unit 10 to thereby increase its practicality; referring to FIG. 1, the mounting base 40 is a substructure that matches the shape of the bottom cover 11 consisting of a constraining wall 41 extending along its peripheral edge, a pair of inverted L-shaped protrusions 42 on its end surface that correspond in reverse to the positions of the L-shaped projections 112 at the bottom side of the bottom cover 11 and which provides for their parallel slip insertion into the L-shaped projections 112, and an elastic clip 43 at the center section of its front side that is divided into two lateral aspects capable of upward and downward flexure, with a pawl section 431 at the top side of the elastic clip 43 extending upward to engage the lip 113 at the bottom side of the bottom cover 11 to prevent backing off and dislodging from the main unit 10, thereby completing assembly into the structural unit shown in FIG. 3; furthermore, a sheet of self-sticking paper (not shown in the drawings) can be affixed to the bottom side of the mounting base 40 for adhesive installation in the interior of a vehicle such that finger pressure applied to the tail end of the elastic clip 43 forces the pawl section 431 at the top side of the elastic clip 43 to become disengaged from the lip 113 at the bottom side of the bottom cover 11, enabling the straight pulling out of the entire main unit 10.

Figure 8:
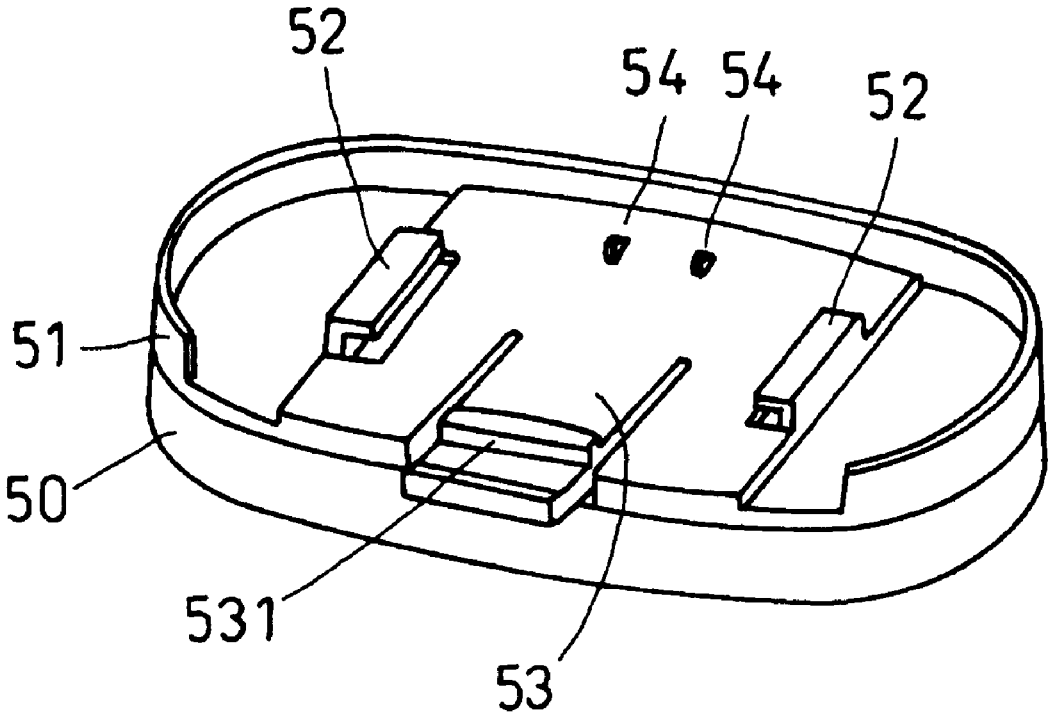
FIG. 8 is an isometric drawing of the external battery mount for the invention herein.
Figure 9:
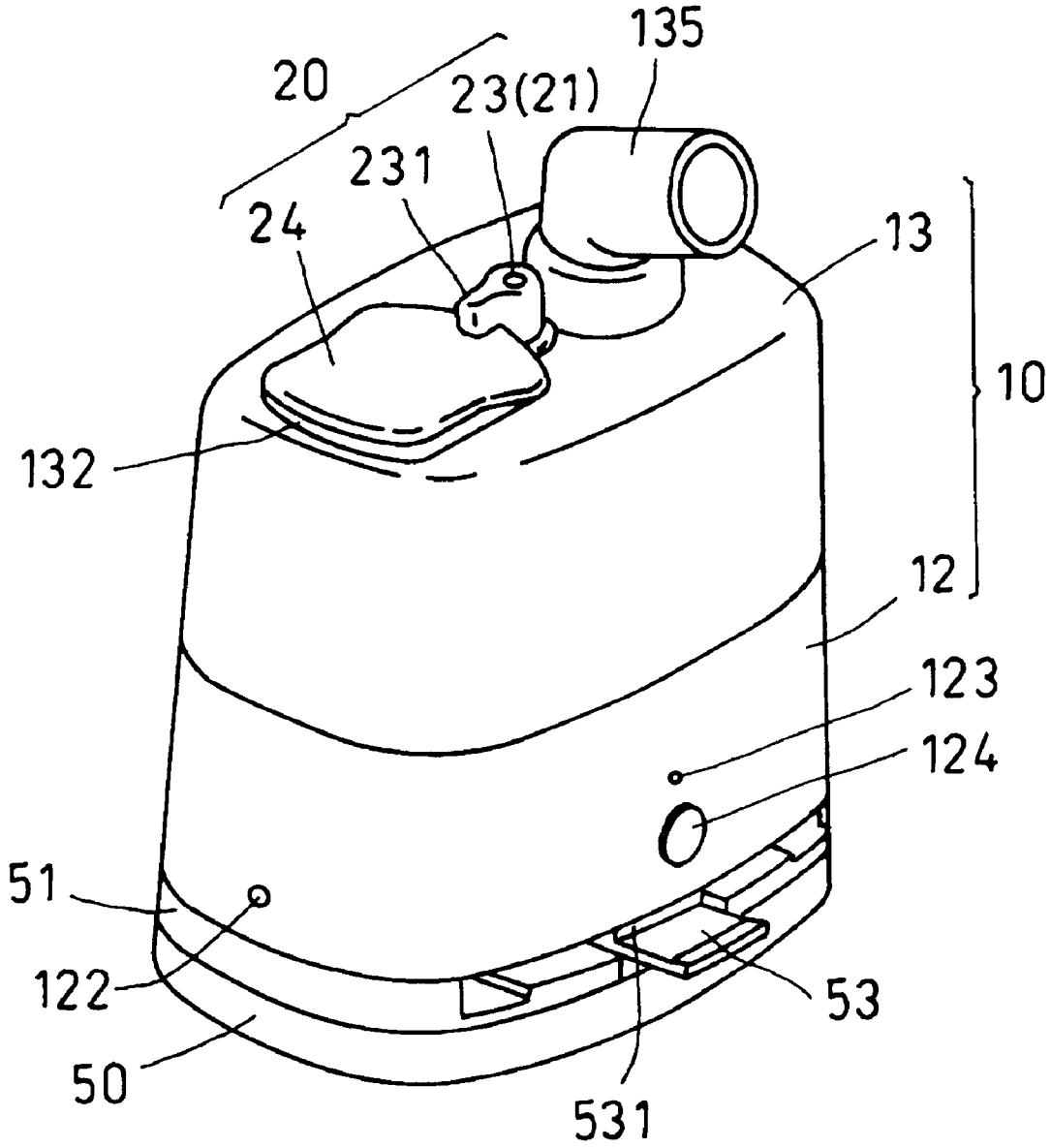
FIG. 9 is an isometric drawing of the external battery mount installed to the invention herein.

Referring to FIG. 8, the battery base 50 is a substructure that matches the shape of the bottom cover 11 consisting of a constraining wall 51 extending along its peripheral edge, a pair of inverted L-shaped protrusions 52 on its end surface that correspond in reverse to the positions of the L-shaped projections 112 at the bottom side of the bottom cover 11 and which provides for their parallel slip insertion into the L-shaped projections 112, and an elastic clip 53 at the center section of its front side that is divided into two lateral aspects capable of upward and downward flexure, with a pawl section 531 at the top side of the elastic clip 53 extending upward to engage the lip 113 at the bottom side of the bottom cover 11 to prevent backing off and dislodging from the main unit 10, thereby completing assembly into the structural unit shown in FIG. 9; power terminals 54 projecting from the top surface of the battery base 50 are utilized to connect by mechanical contact a power source to the similarly aligned power terminals (not shown in the drawings) of the main unit 10 such that the battery base 50 serves as accessory power pack of the invention herein that increases its application and operating mobility.

Based on the disclosure, when the pocket-type ultrasonic atomizer structure of the invention herein is fully assembled and utilized, it is capable of exceptional atomizing performance whether mounted in a vehicle, carried by an individual, or set up indoors; since the present invention provides for the integrated opening and closing of the water supply regulating mechanism 20 and the water reservoir 131 (the adjustment knob 23 rotates the valve 22, while also enabling and disabling the sealed closure of the pressure cover 24), wherein when the adjustment knob 23 is turned to the "OPEN" mark to release the sealed state of the pressure cover 24, the water reservoir 131 is subjected to atmospheric pressure that moves the contained water volume towards the low pressure area; however, due to the unique design of valve control means of the invention herein, the rotation of the valve controlling stem 21 is directly controlled by the adjustment knob 23 such that the valve 22 attached to its bottom end synchronously opens and closes the water input hole 161 at the inner wall of the pipe 16 and, therefore, refilling the water reservoir 131 to a new water volume is not subject to atmospheric pressure that would cause flowing into the accumulator 31, thereby ensuring a normal liquid surface water level for utilization; conversely, when the water reservoir 131 is refilled to a satisfactory water level, the pressure cover 24 is again placed into the filler opening 132 to achieve an air-tight fit, following which the adjustment knob 23 is turned to the "CLOSE" mark and the adjustment knob 23 check section 231 exerts downward pressure that prevents the removal of the pressure cover 24, at which time the valve 22 on the valve controlling stem 21 is synchronously rotated to the previous air-tight sealed position over the water input hole 161 at the inner wall of the pipe 16; as such, the water volume contained in the sealed water reservoir 131 incrementally replenishes the water volume required by the atomization chamber 36, the water volume flowing into the accumulator 31 through the opened water input hole 161 at the inner wall of the pipe 16 to supplement and maintain the preset liquid surface height required for atomization by the accumulator 31, thereby achieving low-voltage atomizer performance.

Furthermore, due to the unique structural design of the atomizing unit 30 elastic sleeve 32, the inner conical section 321 protruding axially from its top end is utilized for press-fit insertion into the conical space 311 at the bottom side of the accumulator 31, while its annular edge 325 supports the fastening of the circuit board 35, thereby achieving a thorough leak-proofing capacity that offers superior sealing compared to the single anti-leak washer of the prior art, and wherein the stepped design of the inner conical section 321 shoulder section 322 enables the formation of small diameter constricted passage 323 at the bottom side of the orifice 313 and provides for a larger water volume capacity under the accumulator 31 conical space 311 such that when water in the accumulator 31 is reduced to the minimum level, there is still a sufficient quantity of water on the vibrator element 33, thereby increasing vibrator element 33 protection; at the same time, the discharge surface area of the vibrator element 33 is effectively widened, enabling the appropriate lengthening of the distance between the end opening of the accumulator 31 orifice 313 and the end surface of the aligned vibrator element 33 such that sonic waves concentrated in the area generates an even larger sonic field which allows the vibrator element 33 to atomize liquid at maximum efficiency.

In summation of the foregoing section, the technological concept and original spatial arrangement of the pocket-type ultrasonic atomizer structure of the invention herein is capable of overcoming the problems of the conventional atomizers and in addition to exceptional low-voltage atomizing performance, is an innovation that is more portable, suitable for a wider range of applications, and possesses greater practical utility than the prior art.

What is claimed is:

1. An ultrasonic atomizer structure comprising:

a main unit, a water supply regulating mechanism, and an atomizing unit, said main unit including a bottom cover, a middle casing, and an upper casing assembled into a vertical body; said bottom cover secured onto an underside of said middle casing; said middle casing including a compartment into which a fan is installed, a hollow ventilator duct and a hollow pipe extending vertically from a top side of said middle casing, a water input hole formed in said pipe near a bottom end of said pipe and a connective channel disposed between said pipe and said ventilator duct; said upper casing hermetically conjoined to a top section of said middle casing, a sealed interior section formed between said upper casing and said middle casing to form a water reservoir, a filler opening for adding water, a pivot hole, and an output port for diffusing atomized particles respectively disposed on a top side of said upper casing, a mist tube movably sleeved onto a mouth of said output port;

said water supply regulating mechanism comprising a valve controlling stem which is an active tubular component installed inside said middle casing hollow pipe, having a valve on a bottom end that is aligned with an inner diameter of said pipe and an adjustment knob at a top end, said adjustment knob being utilized to rotate said valve controlling stem within a range of preset angles, thereby synchronously controlling said valve to open or close said water input hole at an inner wall of said pipe; a pressure cover frictionally fitted into said upper casing filler opening and secured in place by a check section projecting from said adjustment knob that exerts downward pressure against a top side of said upper casing;

said atomizing unit comprising an accumulator, an elastic sleeve, a vibrator element, a conductive ring, and a circuit board, said accumulator disposed at a lower extent of said upper casing ventilator duct within the sealed interior section of an atomization chamber which has a conical space at its bottom end, an orifice through a center of said conical space, an annular groove section of a tapered contour formed around said orifice, a coupling ring placed around said annular groove section, and a circular wall extending outward axially and concentrically from an outer circumference of said coupling ring; said elastic sleeve being a soft insulation fitting having an inner conical section for aligned insertion into said conical space of said accumulator, an annular shoulder section of a stepped profile contoured downward along an inner diameter of said conical section that produces a constricted passage of a very small diameter at a bottom side of said orifice, a round hole that is aligned with said accumulator orifice, an annular edge extending downward from an outer diameter of said elastic sleeve, and an enclosing space receding towards its interior section; said vibrator element inserted flat into said elastic sleeve enclosing space and being capable of generating a sonic field sufficient to efficiently atomize liquid from said water reservoir; said conductive ring being a thin annular component dimensioned to fit into said enclosing space having an end surface firmly attached to a bottom side of said vibrator element; and said circuit board being an electronic control circuit tightly fastened to said accumulator within an interior section of said middle casing compartment.

2. The ultrasonic atomizer structure as claimed in claim 1, wherein said bottom cover has two L-shaped projections each extending in parallel with its bottom side for assembly onto a mounting base underneath; said mounting base being a substructure that matches a shape of said bottom cover consisting of a constraining wall extending along its peripheral edge, a pair of inverted L-shaped protrusions on its end surface that corresponds in reverse to positions of said L-shaped projections at a bottom side of said bottom cover and which provides for their parallel slip insertion into said L-shaped projections, and an elastic clip at a center section of its front side that is divided into two lateral aspects capable of upward and downward flexure, with a pawl section at a top side of said elastic clip extending upward to engage a lip at the bottom side of said bottom cover to prevent backing off and dislodging from said main unit; a bottom side of said mounting base is then secured in an interior of the vehicle.

3. The ultrasonic atomizer structure as claimed in claim 1, wherein said bottom cover has two L-shaped projections each extending in parallel with its bottom side for assembly onto a battery base underneath; said battery base being a substructure that matches a shape of said bottom cover consisting of a constraining wall extending along a peripheral edge of said bottom cover, a pair of inverted L-shaped protrusions on its end surface that corresponds in reverse to positions of said L-shaped projections at a bottom side of said bottom cover and which provides a parallel slip insertion into said L-shaped projections, a the center section of a front side of an elastic clip divided into two lateral aspects capable of upward and downward flexure, with a pawl section at a top side of the elastic clip extending upward to engage a lip at the bottom side of said bottom cover to prevent backing off and dislodging from said main unit, power terminals projecting from its top surface that mechanically contacts power terminals of said main unit to establish electrical continuity with batteries.

* * * * *